US005578234A

United States Patent [19]

Corona, III et al.

[11] Patent Number: 5,578,234

[45] Date of Patent: Nov. 26, 1996

[54] DRYER-ACTIVATED FABRIC CONDITIONING COMPOSITIONS CONTAINING UNSATURATED FATTY ACID

[75] Inventors: Alessandro Corona, III, Maineville; Clyde D. Palmer, Cincinnati; John R. Rusche, Cincinnati; Stephanie Lin-Lin Sung, Cincinnati, all of Ohio

[73] Assignee: The Procter & Gamble Company, Cincinnati, Ohio

[21] Appl. No.: 541,448

[22] Filed: Oct. 10, 1995

Related U.S. Application Data

[63] Continuation of Ser. No. 309,339, Sep. 20, 1994, Pat. No. 5,503,756.

[51] Int. Cl.[6] ..... D06M 13/46

[52] U.S. Cl. ..... 510/519; 554/52; 554/107; 564/291; 564/292; 564/294; 564/296

[58] Field of Search ..... 252/8.6, 8.8, 547; 554/103, 104, 107, 52; 564/291, 292, 294, 296

[56] References Cited

U.S. PATENT DOCUMENTS

| | | | |
|---|---|---|---|
| 3,896,033 | 7/1975 | Grimm, III | 252/8.8 |
| 3,915,867 | 10/1975 | Kang et al. | 252/8.8 |
| 3,936,538 | 2/1976 | Marshall et al. | 427/242 |
| 3,993,571 | 11/1976 | Marshall | 252/8.9 |
| 4,049,858 | 9/1977 | Murphy | 428/136 |
| 4,134,839 | 1/1979 | Marshall | 252/8.6 |
| 4,137,180 | 1/1979 | Naik et al. | 252/8.8 |
| 4,137,345 | 1/1979 | Falivene | 427/242 |
| 4,139,477 | 2/1979 | Hayek et al. | 252/8.8 |
| 4,237,064 | 12/1980 | Reck | 260/459 |
| 4,237,155 | 12/1980 | Kardouche | 427/242 |
| 4,308,024 | 12/1981 | Wells | 8/137 |
| 4,327,133 | 4/1982 | Rudy et al. | 427/242 |
| 4,401,578 | 8/1983 | Verbruggen | 252/8.8 |
| 4,426,299 | 1/1984 | Verbruggen | 252/8.8 |
| 4,460,644 | 7/1984 | Pavlich | 428/314.4 |
| 4,767,547 | 8/1988 | Straathof et al. | 252/8.8 |
| 4,830,771 | 5/1989 | Ruback et al. | 252/8.8 |
| 4,863,619 | 9/1989 | Borcher, Sr. et al. | 252/8.6 |
| 4,970,008 | 11/1990 | Kandathil | 252/8.8 |
| 5,062,973 | 11/1991 | Kellett | 252/8.75 |
| 5,080,810 | 1/1992 | Smith et al. | 252/8.6 |
| 5,093,014 | 3/1992 | Neillie | 252/8.8 |
| 5,094,761 | 3/1992 | Trinh et al. | 252/8.8 |
| 5,102,564 | 4/1992 | Garklik et al. | 252/8.9 |
| 5,139,687 | 8/1992 | Borgher, Sr. et al. | 252/8.6 |
| 5,185,088 | 2/1993 | Hartman et al. | 252/8.6 |
| 5,221,794 | 6/1993 | Ackerman et al. | 548/349.1 |
| 5,223,628 | 6/1993 | Whittlinger | 548/349.1 |
| 5,234,610 | 8/1993 | Gardlik et al. | 252/8.6 |
| 5,236,615 | 8/1993 | Trinh et al. | 252/174.11 |
| 5,284,650 | 2/1994 | Whittlinger | 424/70 |
| 5,288,847 | 2/1994 | Harmalker et al. | 252/8.8 |
| 5,296,622 | 3/1994 | Uphues et al. | 554/103 |
| 5,300,238 | 4/1994 | Lin et al. | 252/8.6 |
| 5,368,756 | 11/1994 | Vogel et al. | 252/8.8 |
| 5,376,287 | 12/1994 | Borcher, Sr. et al. | 252/8.8 |

FOREIGN PATENT DOCUMENTS

| | | |
|---|---|---|
| 2021322 | 1/1991 | Canada . |
| 0280550 | 8/1988 | European Pat. Off. . |
| 284036 | 9/1988 | European Pat. Off. . |
| 0354011A1 | 2/1990 | European Pat. Off. . |
| 0409504A2 | 1/1991 | European Pat. Off. . |
| 0409502 | 1/1991 | European Pat. Off. . |
| 0409503 | 1/1991 | European Pat. Off. . |

*Primary Examiner*—Anthony Green
*Attorney, Agent, or Firm*—Robert B. Aylor

[57] ABSTRACT

The present invention relates to dryer-activated fabric softening compositions and articles, having improved antistatic and/or softening effects, for use in an automatic clothes dryer, especially those comprising, as essential ingredients: (A) fabric softener consisting essentially of: (1) from about 5% to about 95% of preferably biodegradable quaternary ammonium compound selected from the group consisting of the compounds of Formulas I, II, III, and mixtures thereof; (2) from 0% to about 95% highly ethoxylated and/or propoxylated, preferably at least 5 ethylene oxide (EO) and/or propylene oxide (PO) groups per molecule, sugar derivative containing at least one long hydrophobic moiety per molecule; and (3) from 0% to about 95% of carboxylic acid salt of tertiary amine; and (B) from about 1% to about 15%, unsaturated fatty acid having an IV of from about 3 to about 60. The amount of (A) present is at least sufficient to provide softening and/or antistatic effects. The active component(s) (A) can, and preferably do, contain unsaturation to provide improved antistatic benefits.

3 Claims, No Drawings

DRYER-ACTIVATED FABRIC CONDITIONING COMPOSITIONS CONTAINING UNSATURATED FATTY ACID

This is a continuation of application Ser. No. 08/309,339, filed on Sep. 20, 1994 now U.S. Pat. No. 5,503,756.

TECHNICAL FIELD

The present invention relates to an improvement in dryer activated, e.g., dryer-added, softening products, compositions, and/or the process of making these compositions. These products and/or compositions are either in particulate form, compounded with other materials in solid form, e.g., tablets, pellets, agglomerates, etc., or, preferably, attached to a substrate.

SUMMARY OF THE INVENTION

The present invention relates to dryer-activated fabric softening compositions and articles, having improved antistatic and/or softening effects, for use in an automatic clothes dryer. These compositions and/or articles comprise, as essential ingredients:

(A) Fabric softener consisting essentially of:

(1) from about 5% to about 95%, preferably from about 15% to about 90%, more preferably from about 25% to about 85%, and even more preferably from about 25% to about 55%, of biodegradable cationic softener, preferably biodegradable quaternary ammonium compound selected from the group consisting of the compounds of Formulas I, II, and III, and mixtures thereof;

(2) from 0% to about 95%, preferably from about 10% to about 90%, more preferably from about 10% to about 75%, and even more preferably from about 10% to about 55%, of highly ethoxylated and/or propoxylated, preferably at least 5 ethylene oxide (EO) and/or propylene oxide (PO) groups per molecule, more preferably at least about 10, and even more preferably at least about 15, EO groups per molecule, sugar derivative containing at least one long hydrophobic moiety per molecule;

(3) from 0% to about 95%, preferably from about 10% to about 75%, more preferably from about 15% to about 60%, of carboxylic acid salt of tertiary amine in which either one, or both, parts of the salt can contain unsaturation; and (B) from about 1% to about 15%, preferably from about 3% to about 12%, unsaturated fatty acid having an IV of from about 3 to about 60, preferably from about 8 to about 50, more preferably from about 12 to about 45.

The amount of (A) present is at least sufficient to provide softening and/or antistatic effects. The active component(s) (A) can, and preferably do, contain unsaturation to provide improved antistatic benefits.

DETAILED DESCRIPTION OF THE INVENTION

The present invention relates to fabric softening compositions and articles having desirable softening and/or antistatic effects, for use in an automatic clothes dryer. These compositions comprise, as essential ingredients:

(A) Fabric softener consisting essentially of:

(1) from about 5% to about 95%, preferably from about 15% to about 90%, more preferably from about 25% to about 85%, and even more preferably from about 25% to about 55%, of biodegradable cationic softener, preferably biodegradable quaternary ammonium compound selected from the group consisting of the compounds of Formulas I, II, and III, and mixtures thereof;

(2) from 0% to about 95%, preferably from about 10% to about 90%, more preferably from about 10% to about 75%, and even more preferably from about 10% to about 55%, of highly ethoxylated and/or propoxylated, preferably at least 4 ethylene oxide (EO) and/or propylene oxide (PO) groups per molecule, more preferably at least about 10, and even more preferably at least about 15, EO groups per molecule, sugar derivative containing at least one long hydrophobic moiety per molecule;

(3) from 0% to about 95%, preferably from about 10% to about 75%, more preferably from about 15% to about 60%, of carboxylic acid salt of tertiary amine in which either one, or both, parts of the salt can contain unsaturation; and (B) from about 1% to about 15%, preferably from about 3% to about 12%, unsaturated fatty acid having an IV of from about 3 to about 60, preferably from about 8 to about 50, more preferably from about 12 to about 45.

The active components can contain unsaturation for additional antistatic benefits. The components are selected so that the resulting fabric treatment composition has a melting point above about 38° C and is flowable at dryer operating temperatures.

(A) (1) Biodegradable Cationic Softener

Compositions of the present invention can contain from about 5% to about 95%, preferably from about 15% to about 90%, more preferably from about 25% to about 85%, and even more preferably from about 25% to about 55%, of biodegradable cationic softener, preferably an ester quaternary ammonium compound (EQA).

The EQA of the present invention is selected from Formulas I, II, III, and mixtures thereof.

Formula I comprises:

$$(R)_{4-m}—N^+—[(CH_2)_n—Y—R^2]_m\ X^-$$

wherein each Y=—O—C(O)—, or —C(O)—O—; m=1 to 3; each n=is an integer from 1 to 4, and mixtures thereof;

each R substituent is a short chain $C_1$–$C_6$, preferably $C_1$–$C_3$, alkyl group, e.g., methyl, ethyl, propyl, and the like; a short chain $C_1$–$C_4$ hydroxy alkyl group; benzyl; or mixtures thereof, with, preferably, at least one R group being short chain alkyl, preferably methyl;

each $R^2$ is a long chain, saturated and/or unsaturated (IV of from about 3 to about 60), $C_8$–$C_{30}$ hydrocarbyl, or substituted hydrocarbyl substituent, preferably straight or branched alkyl or alkenyl chain, preferably containing from about 14 to about 18 carbon atoms, more preferably straight chain, or mixtures thereof; and the counterion, $X^-$, can be any softener-compatible anion, for example, methylsulfate, ethylsulfate, chloride, bromide, formate, sulfate, lactate, nitrate, benzoate, and the like, preferably methylsulfate.

Tallow is a convenient and inexpensive source of long chain alkyl and alkenyl materials.

It will be understood that substituents R and $R^2$ of Formula I can optionally be substituted with various groups such as alkoxyl or hydroxyl groups. The preferred compounds can be considered to be diester (DEQA) variations of ditallow dimethyl ammonium methyl sulfate (DTDMAMS), which is a widely used fabric softener. At least 80% of the DEQA is in the diester form, and from 0% to about 20%, preferably less than about 10%, more preferably less than about 5%, can be EQA monoester (e.g., only one —Y—$R^2$ group).

The following are non-limiting examples of EQA Formula I (wherein all long-chain alkyl substituents are straight-chain):

Saturated $[C_2H_5]_2{}^+N[CH_2CH_2OC(O)C_{17}H_{35}]_2\ (CH_3SO_4)^-$ $[CH_3][C_2H_5]^+N[CH_2CH_2OC(O)C_{13}H_{27}]_2\ [HC(O)O]^-$ $[C_3H_7][C_2H_5]^+N[CH_2CH_2OC(O)C_{11}H_{23}]_2\ (CH_3SO_4)^-$ $[CH_3]_2{}^+N\text{-}[CH_2CH_2OC(O)C_{17}H_{35}]CH_2CH_2OC(O)C_{15}H_{31}\ (CH_3SO_4)^-$ $[CH_3]_2{}^+N[CH_2CH_2OC(O)R^2]_2\ (CH_3SO_4)^-$ where —C(O)$R^2$ is derived from saturated tallow.

Unsaturated $[CH_3]_2{}^+N[CH_2CH_2OC(O)C_{17}H_{33}]_2\ (CH_3SO_4)^-$ $[C_2H_5]_2{}^+N[CH_2CH_2OC(O)C_{17}H_{33}]_2\ Cl^-$ $[CH_3][C_2H_5]^+N[CH_2CH_2OC(O)C_{13}H_{25}]_2\ [C_6H_5C(O)O]^-$ $[CH_3]_2{}^+N\text{-}[CH_2CH_2OC(O)C_{17}H_{33}]CH_2CH_2OC(O)C_{15}H_{29}\ (CH_3CH_2SO_4)^-$ $[CH_3]_2{}^+N[CH_2CH_2OC(O)R^2]_2\ (CH_3SO_4)^-$ where —C(O)$R^2$ is derived from partially hydrogenated tallow or modified tallow having the characteristics set forth herein.

Other specific examples of biodegradable Formula I compounds suitable for use in the fabric softening compositions herein are: N-methyl-N,N-di-(2-$C_{14}$–$C_{18}$-acyloxy ethyl), N-2-hydroxyethyl ammonium methylsulfate; $[HO\text{-}CH(CH_3)CH_2][CH_3]^+N[CH_2CH_2OC(O)C_{15}H_{31}]_2\ Br^-$; $[HO\text{-}CH(CH_3)CH_2][CH_3]^+N[CH_2CH_2OC(O)C_{15}H_{29}]_2\ [HC(O)O]^-$; and $[CH_2CH_2OH][CH_3]^+N[CH_2CH_2OC(O)R^2]_2\ (CH_3SO_4)^-$. A preferred compound is N-methyl, N,N-di-(2-oleyloxyethyl) N-2-hydroxyethyl ammonium methylsulfate.

In addition to Formula I compounds, the compositions and articles of the present invention comprise EQA compounds of Formula II:

$$(R^1)_3\text{—}^+N\text{—}(CH_2)_n\text{—}C(YR^2)H\text{—}C(YR^2)H_2\ X^-$$

wherein, for any molecule:

each Y is —O—C(O)— or —C(O)—O—;

each $R^1$ is $C_1$–$C_4$ alkyl or hydroxy alkyl;

$R^2$ and n are defined hereinbefore for Formula I; and wherein preferably $R^1$ is a methyl group, n is 1, Y is —O—C(O)—, each $R^2$ is $C_{14}$–$C_{18}$, more preferably straight chain; and $X^-$ is methyl sulfate.

A specific example of a biodegradable Formula II EQA compound suitable for use in the aqueous fabric softening compositions herein is: 1,2-bis(tallowyl oxy)-3-trimethyl ammoniopropane methylsulfate (DTTMAPMS).

Other examples of suitable Formula II EQA compounds of this invention are obtained by, e.g., replacing "tallowyl" in the above compounds with, for example, cocoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "methylsulfate" in the above compounds with chloride, ethylsulfate, bromide, formate, sulfate, lactate, nitrate, and the like, but methylsulfate is preferred.

Compositions of the present invention can also comprise Formula III compounds:

$$(R)_{4-m}\text{—}N^+\text{—}[(CH_2)_n\text{—}Y\text{—}R^2]_m\ X^-$$

R, $R^2$, m, n, and $X^-$ are previously defined in Formula I; and each Y=—NH—C(O)—; —C(O)—NH—; —C(O)—O—; and —O—C(O)—; wherein at least one Y group is —NH—C(O)— or —C(O)—NH—. An example of this compound is methyl bis(oleyl amidoethyl) 2-hydroxyethyl ammonium methyl sulfate.

Preferably, Component (A)(1) of the present invention is a biodegradable quaternary ammonium compound.

The compounds herein can be prepared by standard esterification and quaternization reactions, using readily available starting materials. General methods for preparation are disclosed in U.S. Pat. No. 4,137,180, incorporated herein by reference.

As used herein, when the diester quat is specified, it will include the monoester quat that is normally present. For the optimal antistatic benefit the percentage of monoester quat should be as low as possible, preferably less than about 20%. The level of monoester quat present can be controlled in the manufacturing of the EQA.

EQA compounds prepared with fully saturated acyl groups are rapidly biodegradable and excellent softeners. However, it has been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value (IV) of the fatty acids, the odor of fatty acid starting material, and/or the EQA. Any reference to IV values herein refers to IV of fatty acyl groups and not to the resulting EQA compound.

Antistatic effects are especially important where the fabrics are dried in a tumble dryer, and/or where synthetic materials which generate static are used. As the IV is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care should be taken to minimize the adverse results of contact of the resulting fatty acyl groups with oxygen and/or bacteria by adding antioxidants, antibacterial agents, etc. The additional expense and effort associated with the unsaturated fatty acyl groups is justified by the superior performance.

Generally, hydrogenation of fatty acids to reduce polyunsaturation and to lower IV to insure good color and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has also been found that for good chemical stability of the diester quaternary compound in molten storage, water levels in the raw material must be minimized to preferably less than about 1% and more preferably less than about 0.5%. Storage temperatures should be kept as low as possible and still maintain a fluid material, ideally in the range of from about 49° C. to about 75° C. The optimum storage temperature for stability and fluidity depends on the specific IV of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

(A) (2) The Ethoxylated/Propoxylated Sugar Derivative

The ethoxylated and/or propoxylated sugar derivative contains a "sugar" moiety, e.g., a moiety derived from, e.g., a polyhydroxy sugar, or sugar alcohol, that contains from about 4 to about 12 hydroxy groups. This sugar moiety is substituted by at least one long hydrophobic group, containing from about 8 to about 30 carbon atoms, preferably from about 16 to about 18 carbon atoms. For improved physical characteristics, e.g., higher melting point, the hydrophobic group can contain more carbon atoms, e.g., 20–22, and/or there can be more than one hydrophobic group, preferably two or, less preferably, three. In general, it is preferred that the hydrophobic group is supplied by esterifying one of the hydroxy groups with a fatty acid. However, the hydrophobic group can be supplied by connecting the hydrophobic group to the sugar moiety by an ether linkage, and/or a moiety containing a carboxy group esterified with a fatty alcohol can be attached to the sugar moiety to provide the desired hydrophobic group.

Sugar moieties include sucrose, galactose, mannose, glucose, fructose, sorbitan, sorbitol, mannitol, inositol, etc., and/or their derivatives such as glucosides, galactosides, etc. Other "sugar" types of moieties containing multiple hydroxy groups can also be used including starch fractions and polymers such as polyglycerols. The sugar moiety can be any polyhydroxy group that provides the requisite number/density of hydroxy groups approximating that of conventional sugar moieties.

The hydrophobic group can be provided by attachment with an ester, ether, or other linkage that provides a stable compound. The hydrophobic group is preferably primarily straight chain, and preferably contains some unsaturation to provide additional antistatic benefits. Such hydrophobic groups and their sources are well known, and are described hereinafter with respect to the more conventional types of softening agents.

The polyalkoxy chain can be all ethoxy groups, and/or can contain other groups such as propoxy, glyceryl ether, etc., groups. In general, polyethoxy groups are preferred, but for improved properties such as biodegradability, glyceryl ether groups can be inserted. Typically there are from about 4 to about 100, preferably from about 10 to about 40, more preferably from about 15 to about 30, ethoxy groups, or their equivalents, per molecule.

An empirical formula is as follows:

$$R_m—(\text{sugar})(R^1O)_n$$

wherein R is a hydrophobic group containing from about 8 to about 30, preferably from about 12 to about 22, more preferably from about 16 to about 18 carbon atoms; "sugar" refers to a polyhydroxy group, preferably derived from a sugar, sugar alcohol, or similar polyhydroxy compound; $R^1$ is an alkylene group, preferably ethylene or propylene, more preferably ethylene; m is a number from 1 to about 4, preferably 2; and n is a number from about 4 to about 100, preferably from about 10 to about 40. $(R^1O)_n$ can be attached to a sugar moiety or link a sugar moiety and R. Preferred compounds of this type are polyethoxylated sorbitan monostearate and polyethoxylated sorbitan tristearate, e.g., Glycosperse S-20 and Glycosperse TS-20, respectively, from Lonza, each of which contain about 20 ethoxylate moieties per molecule, and mixtures thereof.

The level of the polyethoxy sugar derivative is typically at least about 2%, preferably at least about 10%. Preferably the maximum level is no more than about 90%, more preferably no more than about 75%.

The polyethoxy sugar derivative provides improved antistatic properties to the compositions and can provide equivalent antistatic properties to conventional dryer added compositions, and/or articles, even with less, or no, quaternary ammonium softener materials present. It is possible to prepare a dryer-added composition, or article, that is entirely nonionic.

(A)(3) The Carboxylic Acid Salt of Tertiary Amine

Fabric softening compositions employed herein optionally contain, as a preferred component, at a level of from 0% to about 95%, preferably from about 10% to about 75%, more preferably from about 20% to about 60%, carboxylic acid salt of a tertiary amine which has the formula:

$$R^5—N(R^6)(R^7)—H^{(+)(-)}O—C(O)—R^8$$

wherein $R^5$ is a long chain aliphatic group containing from about 8 to about 30 carbon atoms; $R^6$ and $R^7$ are the same or different from each other and are selected from the group consisting of aliphatic groups containing from about 1 to about 30 carbon atoms, hydroxyalkyl groups of the Formula $R^4OH$ wherein $R^4$ is an alkylene group of from about 2 to about 30 carbon atoms, and alkyl ether groups of the formula $R^9(OC_nH_{2n})_m$ wherein $R^9$ is alkyl and alkenyl of from about 1 to about 30 carbon atoms and hydrogen, each n is 2 or 3, and m is from about 1 to about 30, and wherein $R^8$ is selected from the group consisting of unsubstituted alkyl, alkenyl, aryl, alkaryl and aralkyl of about 1 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a melting point of from about 35° C. to about 100° C.

This component can provide the following benefits: superior odor, a decrease in paint softening of the dryer drum, and/or improved fabric softening performance, compared to similar articles without this component. Either $R^5$, $R^6$, $R^7$, and/or $R^8$ chains can contain unsaturation for improved antistatic benefits.

Tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^7$ is an aliphatic chain of from about 1 to about 30 carbon atoms. Particularly preferred tertiary amines for static control performance are those containing unsaturation; e.g., oleyldimethylamine and/or soft tallowalkyldimethylamine.

Examples of preferred tertiary amines as starting material for the reaction between the amine and carboxylic acid to form the tertiary amine salts are: lauryldimethylamine, myristyldimethylamine, stearyldimethylamine, tallowalkyldimethylamine, coconutalkyldimethylamine, dilaurylmethylamine, distearylmethylamine, ditallowalkylmethylamine, oleyldimethylamine, dioleyl methylamine, lauryldi(3-hydroxypropyl)amine, stearyldi(2-hydroxyethyl)amine, trilaurylamine, laurylethylmethylamine, and $C_{18}H_{37}N[(OC_2H_4)_{10}OH]_2$.

Preferred fatty acids are those wherein $R^8$ is a long chain, unsubstituted alkyl or alkenyl group of from about 8 to about 30 carbon atoms, more preferably from about 11 to about 17 carbon atoms. Examples of specific carboxylic acids as a starting material are: formic acid, acetic acid, lauric acid, myristic acid, palmitic acid, stearic acid, oleic acid, oxalic acid, adipic acid, 12-hydroxystearic acid, benzoic acid, 4-hydroxybenzoic acid, 3-chlorobenzoic acid, 4-nitrobenzoic acid, 4-ethylbenzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine tallowate, stearyldimethylamine myristate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

(B) The Unsaturated Fatty Acid

The unsaturated fatty acid is present in the compositions herein at a level of from about 1% to about 15%, preferably from about 3% to about 12%. Typically, the fatty acid is present to improve the processability of the composition, and is admixed with any material, or materials, that are difficult to process, especially as a result of having a high viscosity. The unsaturated fatty acid provides improved viscosity and/or processability, without harming softening or antistatic performance. Saturated fatty acids can harm softening and/or antistatic performance.

Preferred fatty acids are those containing a long chain, unsubstituted alkenyl group of from about 8 to about 30 carbon atoms, more preferably from about 11 to about 17 carbon atoms. Examples of specific carboxylic acids are: oleic acid, linoleic acid, and mixtures thereof. These unsaturated fatty acids can be used in combination with saturated fatty acids like stearic, palmitic, and/or lauric acids. Preferred carboxylic acids are oleic, tinoleic, tallow fatty acids, and mixtures thereof.

The unsaturated fatty acid can be used as a solvent during the quaternization reactions to form the EQA (including Formulas I, II, and/or III) and/or can be used to facilitate processing of the EQA and/or of the fabric softening composition containing the EQA. One can use other possible solvents such as $C_8$–$C_{30}$ saturated fatty acid, and $C_1$–$C_{30}$ alcohols, including fatty alcohols, with secondary and tertiary alcohols being preferred, e.g., isopropanol. The unsaturated fatty acids are preferred to saturated fatty acids for both processing and performance reasons. In particular, unsaturated fatty acids can render component (A)(1) miscible with component (A)(2) whereas saturated fatty acids may not. Also, saturated fatty acids present in the composition, may be detrimental to antistat performance, while unsaturated fatty acids do not negatively impact performance. An additional benefit of unsaturated fatty acids is that they result in readily processable (sufficiently low viscosity) intermediate blends during the making of the composition. Processes for using similar materials as solvents and/or processing aids in reactions to form similar compounds are described in U.S. Pat. Nos.: 4,237,064, Reck, issued Dec. 2, 1980; 5,221,794, Ackerman et al., issued Jun. 22, 1993; 5,223,628, Whittlinger, issued Jun. 22, 1993; and 5,284,650, Whittlinger, issued Feb. 8, 1994, all of said patents being incorporated herein by reference. One can prepare Formulas I, II, and/or III by analogous processes.

As discussed in said patents, fatty materials, like the unsaturated fatty acid, can be added at the beginning of quaternization, e.g., of Component (A)(1), during quaternization, or after quaternization. This can obviate, or minimize, the need to remove any other solvent. Reaction byproducts can occur when the unsaturated fatty acid is present in the quaternization reaction, e.g., this can result in the formation of some fatty acid ester. Therefore, it can be advantageous to use co-solvents in a manner similar to that disclosed in said patents. The co-solvent should be one that can be removed readily or which can be advantageously left in the finished composition after the reaction is completed. It is especially desirable to use as co-solvents materials like the ethoxylated/propoxylated sugar derivatives (A)(2), fatty alcohols, sorbitan monostearate, etc., which are desirable optional ingredients as discussed in more detail hereinbefore and hereinafter, and therefore do not have to be removed. More conventional solvents like isopropanol, etc., are normally removed before use. The use of co-solvents allows one to use less of materials that can cause incompatibility problems with, e.g., dryer surfaces such as certain enamels that are softened by certain organic materials like conventional nonionic surfactants and even fatty acids.

In the process aspect of the present invention, the unsaturated fatty acid is added to the quaternization reaction mixture used to form the biodegradable quaternary ammonium compounds of Formulas I, II, and/or III as described hereinbefore to lower the viscosity of the reaction mixture to less than about 1500 cps, preferably less than about 1000 cps, more preferably less than about 800 cps. The solvent level of added fatty acid is from about 5% to about 30%, preferably from about 10% to about 25%, more preferably from about 10% to about 20%. The unsaturated fatty acid can be added before the start of the quaternization reaction or, preferably, during the quaternization reaction when it is needed to reduce the viscosity which increases with increased level of quaternization. Preferably the addition occurs when at least about 60% of the product is quaternized. This allows for a low viscosity for processing while minimizing side reactions which can occur when the quaternizing agent reacts with the fatty acid. The quaternization reactions are well known and include, e.g., with respect to Formula I compounds, those processes described in U.S. Pat. Nos.: 3,915,867, Kang et al., issued Oct. 28, 1975; 4,830,771, Ruback et al., issued May 16, 1989; and 5,296,622, Uphues et al., issued Mar. 22, 1994, all of said patents being incorporated herein by reference.

The resulting quaternized biodegradable fabric softening compounds can be used without removal of the unsaturated fatty acid, and, in fact, are more useful since the mixture is more fluid and more easily handled. The fabric softening compositions formed using the mixture of biodegradable cationic fabric softener compound and unsaturated fatty acid are also more easily handled since they are more fluid. Surprisingly, the processing benefits are achieved without sacrificing performance as would be the case with saturated fatty acids. Also, the unsaturated fatty acids make the biodegradable cationic fabric softener compound, and the resulting solid fabric softener compositions, easier to handle than saturated fatty acids do.

(D) Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

(1) Optional Nonionic Softener

A highly preferred optional ingredient is a nonionic fabric softening agent/material other than those disclosed hereinbefore. Typically, such nonionic fabric softener materials have an HLB of from about 2 to about 9, more typically from about 3 to about 7. In general, the materials selected should be relatively crystalline, higher melting (e.g., >25° C.). These materials can then improve processability of the composition.

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 16 to about 20, carbon atoms. Typical examples of said fatty acids being lauric acid, myristic acid, palmitic acid, stearic acid, oleic acid, and behenic acid. Typically, such softeners contain from about 1 to about 4, preferably about 2 fatty acid groups per molecule.

The polyhydric alcohol portion of the ester can be ethylene glycol, polyethylene glycol, (e.g., tetraethylene glycol), glycerol, poly (e.g., di-, tri-, tetra, penta-, and/or hexa-) glycerol, xylitol, sucrose, erythritol, pentaerythritol, sorbitol or sorbitan. These nonionic fabric softening materials do not include the ethoxylated sugar derivatives disclosed hereinbefore. They typically contain no more than about 4 ethoxy groups per molecule.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 4 oxyethylene units, and mixtures thereof. For the purpose of the present invention, sorbitan esters containing unsaturation (e.g., sorbitan monooleate) are preferred.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids and ethylene and/or propylene oxides. Such a method of sorbitan ester preparation is described more fully in MacDonald; "Emulsifiers: Processing and Quality Control", *Journal of the American Oil Chemists' Society*, Vol. 45, October 1968.

Details, including formula, of the preferred sorbitan esters can be found in U.S. Pat. No. 4,128,484, incorporated hereinbefore by reference.

For the purposes of the present invention, it is preferred that a significant amount of di-, and tri-, and/or tetra-sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of commercial sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, sorbitan tristearate, and mixtures thereof, and mixed tallowalkyl sorbitan mono-, di-, and tri-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or diesters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated with no more than about 4 ethoxy groups per molecule to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono and/or diesters of the polyglycerol polyols are preferred, the fatty acyl groups typically being those described hereinbefore for the sorbitan and glycerol esters.

(2) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sept. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6: 1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published June 25, 1986, incorporated herein by reference.

(3) Cyclodextrin/Perfume Complexes and Free Perfume

The products herein can also contain from about 0.5% to about 60%, preferably from about 1% to about 50%, cyclodextrin/perfume inclusion complexes, as disclosed in U.S. Pat. Nos. 5,139,687, Borcher et al., issued Aug. 18, 1992; and 5,234,610, Gardlik et al., issued Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective. The volatility and substantivity of perfumes is disclosed in U.S. Pat. No. 5,234,610, supra.

If a product contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(4) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include ascorbic acid, ascorbic palmitate, propyl gallate, available from Eastman Chemical Products, Inc., under the trade names Tenox® PG and Tenox S-1; a mixture of BHT, BHA, propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; Irganox 3125® from Ciba-Geigy; and butylated hydroxyanisole, Eastman Chemical Products, Inc., as BHA.

Examples of reductive agents include sodium borohydride, hypophosphorous acid, and mixtures thereof.

The stability of the compounds and compositions herein can be helped by the stabilizers, but in addition, the preparation of compounds used herein and the source of hydrophobic groups can be important. Surprisingly, some highly desirable, readily available sources of hydrophobic groups such as fatty acids from, e.g., tallow, possess odors that remain with the compound, e.g., DEQA despite the chemical and mechanical processing steps which convert the raw tallow to finished DEQA. Such sources must be deodorized, e.g., by absorption, distillation (including stripping such as steam stripping), etc., as is well known in the art. In addition, care should be taken to minimize contact of the resulting fatty acyl groups to oxygen and/or bacteria by adding antioxidants, antibacterial agents, etc. The additional expense and effort associated with the unsaturated fatty acyl groups is justified by the superior performance.

(5) Other Optional Ingredients

The present invention can include other optional components (minor components) conventionally used in textile treatment compositions, for example, colorants, preservatives, optical brighteners, processing aids like sodium alkyl benzene sulfonate surfactants, opacifiers, physical stabilizers such as guar gum and polyethylene glycol, anti-shrinkage agents, anti-wrinkle agents, fabric crisping agents, spotting agents, germicides, fungicides, anti-corrosion agents, antifoam agents, and the like.

(D) Substrate Articles

In preferred embodiments, the present invention encompasses articles of manufacture. Representative articles are those that are adapted to soften fabrics in an automatic laundry dryer, of the types disclosed in U.S. Pat. Nos.: 3,989,63 1, Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28,1989; 4,103,047, Zaki et al., issued July 25, 1978; 3,736,668, Dillarstone, issued June 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart fabric soil release, antistatic effect and/or softness benefits during several cycles of clothes. This multi-use article can be made by filling a hollow sponge with about 20 grams of the fabric treatment composition.

(E) Usage

The substrate embodiment of this invention can be used for imparting the above-described fabric treatment composition to fabric to provide softening and/or antistatic effects to fabric in an automatic laundry dryer. Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition preferably comprises from about 0% to about 90%, preferably from about 10% to about 75%, of the ethoxylated sugar derivative and from about 10% to about 95%, preferably from about 20% to about 75%, more preferably from about 20% to about 60% of the above-defined co-softeners.

The present invention relates to improved solid dryer-activated fabric softener compositions which are either (A) incorporated into articles of manufacture in which the compositions are, e.g., on a substrate, or are (B) in the form of particles (including, where appropriate, agglomerates, pellets, and tablets of said particles).

All percentages, ratios, and parts herein, in the Specification, Examples, and Claims, are by weight and approximations unless otherwise stated.

The following are nonlimiting examples of the instant articles, methods, and compositions of the present invention.

EXAMPLE 1

| Components | Wt. % |
|---|---|
| Co-softener* | 20.34 |
| Glycosperse S-20 | 14.67 |
| DEEHMAMS | 34.12 |
| Tallow fatty acid ($C_{16-18}$, IV = 42) added partway through DEEHMAMS quaternization | 8.53 |
| Perfume/Cyclodextrin Complex | 17.21 |
| Clay** | 3.01 |
| Free Perfume | 1.45 |
| Sodium $C_{13}$ alkyl benzene sulfonate | 0.67 |
| | 100.0 |

Glycosperse S-20 is polyethoxylated sorbitan monostearate, from Lonza, which contains about 20 ethoxylate moieties per molecule.

DEEHMAMS is di($C_{16-18}$ unsaturated ethylester)hydroxyethylmethyl-ammonium methylsulfate.

*1:2 ratio of stearyidimethylamine:triple-pressed stearic acid.

**Calcium bentonite clay, Bentolite L, sold by Southern Clay Products, or Gelwhite GP clay.

PREPARATION OF THE COATING MIX

The coating mix is prepared as follows. A portion of the DEEHMAMS containing about 20% tallow fatty acid and Glycosperse S-20 are melted separately at about 80° C. and then combined with high shear mixing. The perfume/cyclodextrin complex is ground and slowly added to the mixture with high shear mixing. The sodium $C_{13}$ alkyl benzene sulfonate is also added to the mixture. During the mixing, the mixture is kept molten in a hot water bath at about 70°–80° C. This intermediate blend is milled in a ball mill at about 250 rpm for about 5 minutes, with the resultant particle size being an average of around 20–50 μm. The co-softener, remaining Glycosperse S-20, and remaining DEEHMAMS containing about 20% tallow fatty acid are added to the milled blend with high shear mixing. The calcium bentonite clay is slowly added to the mixture with high shear mixing until the desired viscosity is achieved. The perfume is added to the mixture, and the formula is mixed until the mixture is smooth and homogeneous.

PREPARATION OF FABRIC CONDITIONING SHEETS

The coating mixture is applied to preweighed substrate sheets of about 6.75 inches×12 inches (approximately 17 cm×30 cm) dimensions. The substrate sheets are comprised of about 4-denier spun bonded polyester. A small amount of the formula is placed on a heated metal plate with a spatula and then is spread evenly with a wire metal rod. A substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target sheet weight is 3.56 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

EXAMPLE 2

The coating mix preparation and the making of the fabric conditioning sheets are similar to those in Example 1, except that the tallow fatty acid is added at the beginning of the DEEHMAMS quaternization.

EXAMPLE 3

The coating mix preparation and the making of the fabric conditioning sheets are similar to those in Example 1, except that the tallow fatty acid is post added to the DEEHMAMS after the DEEHMAMS is quaternized in isopropanol. The isopropanol is then stripped off to a level of ≦0.5%.

EXAMPLE 4

| Components | Wt. % |
|---|---|
| Co-softener* | 21.25 |
| DEEHMAMS | 35.64 |
| Tallow fatty acid ($C_{16-18}$, IV = 42) added partway through DEEHMAMS quaternization | 4.45 |
| Glycosperse S-20 (added as cosolvent to DEEHMAMS after quaternization) | 4.45 |
| Glycosperse S-20 (added later) | 10.87 |
| Perfume/Cyclodextrin Complex | 17.98 |
| Clay** | 3.15 |
| Free Perfume | 1.51 |
| Sodium $C_{13}$ alkyl benzene sulfonate | 0.69 |
| | 100.0 |

The coating mix preparation and the making of the fabric conditioning sheets are similar to those in Example 1, except that the Glycosperse S-20 is added at two separate times, one with the fatty acid to act as a solvent for the DEEHMAMS after quaternization and one as part of the overall preparation of the coating mix.

EXAMPLE 5

The coating mix preparation and the making of the fabric conditioning sheets are similar to those in Example 4, except that Glycosperse S-15 is used instead of Glycosperse S-20.

EXAMPLE 6

The coating mix preparation and the making of the fabric conditioning sheets are similar to those in Example 4, except that Glycosperse TS-20 is used instead of Glycosperse S-20.

EXAMPLE 7

| Components | Wt. % |
|---|---|
| Co-softener*** | 39.21 |
| Dimethyl bis(tallowoxyethyl)ammonium methylsulfate | 27.91 |
| Sorbitan monostearate (SMS) | 26.22 |
| Clay** | 4.72 |
| Free Perfume | 1.94 |
| | 100.0 |

***1:2 ratio of stearyldimethylamine:soft tallow fatty acid (IV of fatty acid is 40–50).

The excess fatty acid in the co-softener provides the unsaturated fatty acid.

The coating mix preparation and the making of the fabric conditioning sheets are similar to those in Example 1 with the SMS and dimethyl bis(tallowoxyethyl)ammonium methylsulfate replacing the Glycosperse S-20 and DEEHMAMS, respectively, in the processing of the coating mix.

EXAMPLES 8–11

The coating mix preparation and the making of the fabric conditioning sheets for EXAMPLES 8, 9, 10, and 11, respectively, are similar to those in Examples 1, 2, 3, and 4 respectively, except that the co-softener is a 1:2 ratio of stearyldimethylamine:soft tallow fatty acid (IV of fatty acid is 40–50) instead of stearyldimethylamine and triple-pressed stearic acid. The excess fatty acid in the co-softener serves as an additional source of the unsaturated fatty acid.

EXAMPLE 12

A 4-neck, 1-liter reaction flask fitted with a stirrer, thermometer, nitrogen inlet and a vacuum distillation assembly is charged with about 500 g (1.81 mol) of fatty acid (approximately 40% oleic, 26% palmitic, 25% stearic, 9% minors, IV=approximately 42), about 135 g (0.905 mol) of triethanolamine and about 8 g (25% solution in methanol) of sodium methoxide solution. The mixture is stirred and heated to 91°–105° C. under vacuum (about 28 in. Hg) and nitrogen flow (about 50 cc/min) for about 1 hour and 45 minutes. Approximately 587 g (0.89 mol) of the amine ester is obtained with a Gardner color reading of about 1.

This amine ester is then quaternized by taking about 350 g (0.53 mol) of the amine ester and slowly reacting it with about 67.2 g (0.53 mol) of dimethyl sulfate at a temperature of about 97° C. During the quaternization, the viscosity of the reaction mixture increases to over 500 cps. When the total amine value is approximately 20, an additional 88.1 g (0.32 mol) of said fatty acid is charged to the reactor to reduce the viscosity to less than about 1000 cps at 70° C., and the quaternization reaction is completed with this excess fatty acid present. The total quaternization reaction time is about 2 hours. The resultant product is about 350 g (0.52 mol) of N,N-di(fattyacyloxyethyl)-N,N-dimethylammonium methyl sulfate diluted with about 15–20 wt % of free fatty acid. This product contains less than about 5% methyl esters and has a viscosity less than about 1000 cps at 70° C.

EXAMPLE 13

Example 13 is similar to Example 12 except that the excess of said fatty acid is added at the beginning of the quaternization rather than partway through the quaternization. The resultant product generally contains a higher level of methyl esters than the product of Example 12.

EXAMPLE 14

Example 14 is similar to Example 13 except that instead of adding said fatty acid at the beginning of the quaternization, about 38.9 g of isopropanol is added. The quaternization is conducted in the isopropanol medium. After the quaternization is complete, about 88.1 g (0.32 mol) of said fatty acid is added to the mixture and the isopropanol is then stripped off under vacuum to yield a product with relatively low, if any, methyl ester.

EXAMPLE 15

Example 15 is similar to Example 12 except that instead of adding about 88.1 g of said fatty acid partway through the quaternization, only about 44 g (0.16 mol) of said fatty acid is added at this point. After the quaternization reaction is completed, about 44 g (0.03 mol) of Glycosperse S-20 is added as a co-solvent.

What is claimed is:

1. In a quaternization process for preparing a quaternary ammonium compound having Formula I, Formula II, Formula III, or mixtures thereof, said process comprising the step of forming a quaternization reaction mixture having a viscosity, wherein: said Formula I comprises:

$$(R)_{4-m}—N^+—[(CH_2)_n—Y—R^2]_m\ X^-$$

wherein each Y=—O—C(O)—, or —C(O)—O—; m=1 to 3; each n=is an integer from 1 to 4, and mixtures thereof;

each R substituent is a short chain $C_1$–$C_6$ alkyl group; a short chain $C_1$–$C_4$ hydroxy alkyl group; benzyl; or mixtures thereof;

each $R^2$ is a long chain, saturated or unsaturated, with an Iodine Value of from about 3 to about 60, $C_8$–$C_{30}$ hydrocarbyl, or substituted hydrocarbyl substituent; and the counterion, $X^-$, can be any softener-compatible anion;

said Formula II comprises:

$$(R^1)_3—^+N—(CH_2)_n—C(YR^2)H—C(YR^2)H_2\ X^-$$

wherein, for any molecule:each Y is —O—C(O)— or —C(O)—O—;

each $R^1$ is $C_1$–$C_4$ alkyl or hydroxy alkyl; and $R^2$, $X^-$, and n are as defined herein before for Formula I; and said Formula III comprises:

$$(R)_{4-m}—N^+—[(CH_2)_n—Y—R^2]_m\ X^-$$

wherein R, $R^2$, m, n, and $X^-$ are as previously defined in Formula I; and each Y=—NH—C(O)—; —C(O)—NH—; —C(O)—O—; and —O—C(O)—; wherein at least one Y group is —NH—C(O)— or —C(O)—NH—;

the improvement in which unsaturated fatty acid having an Iodine Value of from about 3 to about 60 is added at a level of from about 5% to about 30% to the quaternization reaction mixture to reduce, maintain, or reduce and maintain the viscosity at less than about 1000 cps at 70° C., the viscosity in the absence of the unsaturated fatty acid being more than about 1500 cps at 70° C.

2. The process of claim 1 wherein the quaternary ammonium compound has Formula I, the level of unsaturated fatty acid is from about 10% to about 25%, and the Iodine Value of the unsaturated fatty acid is from about 8 to about 50.

3. The process of preparing a dryer-activated fabric conditioning composition comprising the step of combining:

(A) fabric softener consisting essentially of:

(1) from about 5% to about 95% of biodegradable quaternary ammonium compound selected from the group consisting of the compounds of Formulas I, II, Ill, and mixtures thereof, as prepared by the process of claim 1;

(2) at least about 5% sugar derivative containing at least 5 groups selected from the group consisting of: ethoxy groups; propoxy groups; and mixtures thereof and one long hydrophobic moiety per molecule; and (3) from 0% to about 95% of carboxylic acid salt of a tertiary amine; and (B) from about 1% to about 15% unsaturated fatty acid having an Iodine Value of from about 3 to about 60 wherein:

said Formula I comprises:

$$(R)_{4-m}—N^+—[(CH_2)_n—Y—R^2]_m\ X^-$$

wherein each Y=—O—C(O)—, or —C(O)—O—; m=1 to 3; each n=is an integer from 1 to 4, and mixtures thereof;

each R substituent is a short chain $C_1$–$C_6$ alkyl group; a short chain $C_1$–$C_4$ hydroxy alkyl group; benzyl; or mixtures thereof;

each $R^2$ is a long chain, saturated or unsaturated with an Iodine Value or from about 3 to about 60, $C_8$–$C_{30}$ hydrocarbyl, or substituted hydrocarbyl substituent; and the counterion, $X^-$, can be any softener-compatible anion;

said Formula II comprises:

$$(R^1)_3—^+N—(CH_2)_n—C(YR^2)H—C(YR^2)H_2\ X^-$$

wherein, for any molecule:each Y is —O—C(O)— or —C(O)—O—; each $R^1$ is $C_1$–$C_4$ alkyl or hydroxy alkyl; and $R^2$, $X^-$, and n are as defined herein before for Formula I; and said Formula III comprises:

$$(R)_{4-m}—N^+—[(CH_2)_n—Y—R^2]_m\ X^-$$

wherein R, $R^2$, m, n, and $X^-$ are as previously defined in Formula I; and each Y=—NH—C(O)—; —C(O)—NH—; —C(O)—O—; and —O—C(O)—; wherein at least one Y group is —NH—C(O)— or —C(O)—NH—.

* * * * *